United States Patent [19]

Silvestri, Jr. et al.

[11] Patent Number: 5,056,986

[45] Date of Patent: Oct. 15, 1991

[54] INNER CYLINDER AXIAL POSITIONING SYSTEM

[75] Inventors: George J. Silvestri, Jr., Winter Park; Alvin L. Stock, Casselberry; Michael Twerdochlib, Oviedo, all of Fla.

[73] Assignee: Westinghouse Electric Corp., Pittsburgh, Pa.

[21] Appl. No.: 440,070

[22] Filed: Nov. 22, 1989

[51] Int. Cl.[5] ..... F01D 21/00

[52] U.S. Cl. ..... 415/14; 415/127; 415/131; 324/207.24

[58] Field of Search ..... 415/14, 19, 129, 126, 415/127, 131, 118, 30, 34; 92/138; 73/660; 324/207.22, 207.25, 207.26, 207.12

[56] References Cited

U.S. PATENT DOCUMENTS

| | | | |
|---|---|---|---|
| 1,281,490 | 10/1918 | Billado | 92/138 |
| 2,707,941 | 5/1955 | Hardy | 92/138 |
| 2,748,613 | 6/1956 | Guay | 92/138 |
| 2,864,392 | 12/1958 | Ziegelmeyer | 92/138 |
| 3,058,339 | 10/1962 | Shapiro | 73/660 |
| 3,754,433 | 8/1973 | Hyer | 415/14 |
| 4,072,893 | 2/1978 | Huwyler | 324/207.25 |
| 4,153,388 | 5/1979 | Naegeli et al. | 415/118 |
| 4,180,329 | 12/1979 | Hildebrand | 415/118 |
| 4,326,804 | 4/1982 | Mossey | 415/118 |
| 4,343,592 | 8/1982 | May | 415/14 |
| 4,384,819 | 5/1983 | Baker | 415/127 |
| 4,423,635 | 1/1984 | Senicourt et al. | 73/660 |
| 4,518,917 | 5/1985 | Oates et al. | 73/660 |
| 4,568,240 | 2/1986 | Ichikawa | 415/14 |
| 4,612,501 | 9/1986 | Costello et al. | 324/207.25 |
| 4,632,635 | 12/1986 | Thoman et al. | 415/14 |
| 4,657,479 | 4/1987 | Brown et al. | 415/127 |
| 4,683,716 | 8/1987 | Wright et al. | 415/127 |
| 4,700,127 | 10/1987 | Sasaki et al. | 415/14 |
| 4,842,477 | 6/1989 | Stowell | 415/14 |
| 4,934,192 | 6/1990 | Jenkins | 73/660 |

FOREIGN PATENT DOCUMENTS

| | | | |
|---|---|---|---|
| 2160365 | 6/1973 | Fed. Rep. of Germany | 92/138 |
| 1016543 | 5/1983 | U.S.S.R. | 415/14 |
| 1344617 | 1/1974 | United Kingdom | 415/118 |

*Primary Examiner*—Edward K. Look
*Assistant Examiner*—Hoang Nguyen

[57] ABSTRACT

A positioning system for a steam turbine element includes a plurality of flex plates which support an inner cylinder of a steam turbine element with the rotating blades of a rotor and the stationary blades of the inner cylinder at a predetermined position. Sensors detect shifting of the rotor within the inner cylinder and provide control signals to a motor which drives the inner cylinder in an axial direction to account for shifting of the rotor.

19 Claims, 7 Drawing Sheets

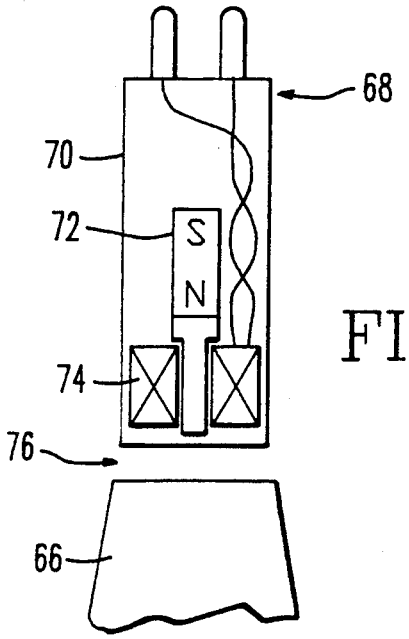
FIG. 8
FIG. 9
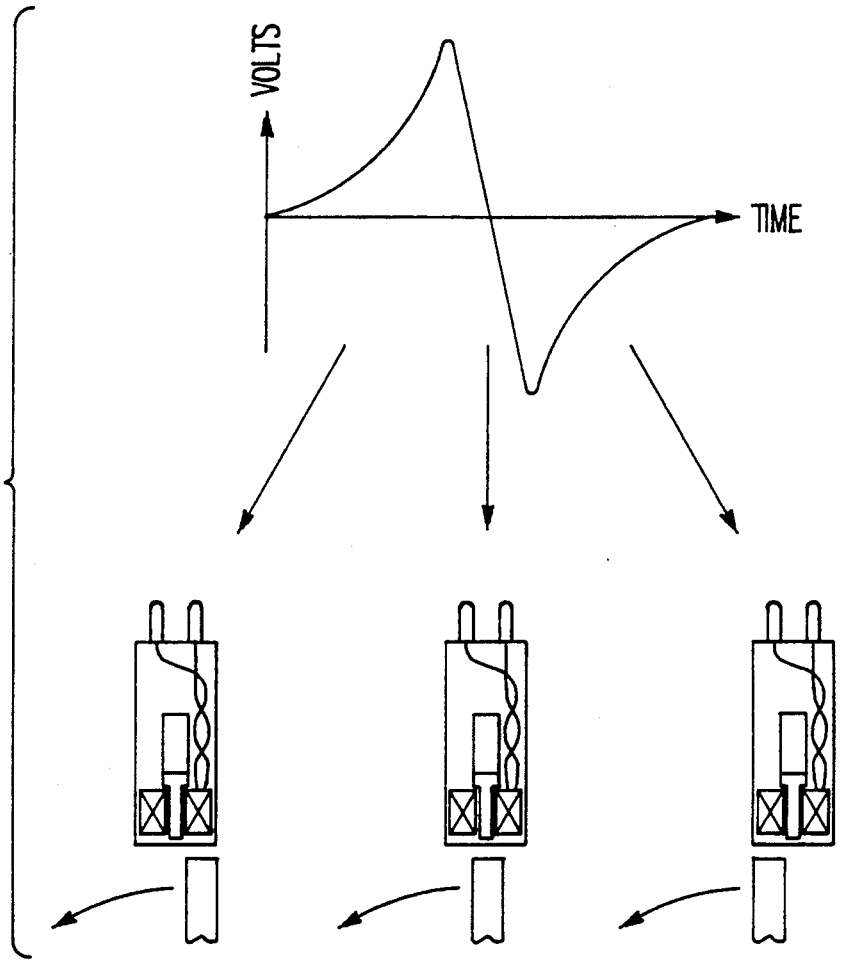

INNER CYLINDER AXIAL POSITIONING SYSTEM

BACKGROUND OF THE INVENTION

1. Field of the Invention

The present invention relates generally to steam turbines and, more specifically, to an inner cylinder axial positioning system for improving blading sealing.

2. Description of the Related Art

The principle components of a steam turbine include a rotor which has mounted thereon several rows of rotating blades and a stationary cylinder in which the rotor rotates. The stationary cylinder has several rows of stationary blades which extend inwardly toward the rotor, while the rotating blades extend outwardly toward the inner diameter of the cylinder. Seals are provided between the tips of the stationary and rotating turbine blades and corresponding portions of the cylinder and rotor.

Because of differences in thermal expansion, and because of different anchoring points of the rotor and the stationary parts of turbines, the rotor will be displaced axially relative to the cylinder and stationary blades. As a consequence, the number and type of blade seals are affected, resulting in increased leakage. In addition, turbine element length increases because the space between rotating in stationary parts must be increased. This is of concern on retrofit low pressure elements because efficiency can be increased by increasing the number of stages (or blade rows) and the increased blade path span requirements can encroach on the flow area at the inlet zone. This leads to higher inlet velocities and higher flow distribution losses, resulting in higher inlet pressure drop.

Also, because of the aforementioned relative movement, the axial space between the rotor and stationary blades in the wet steam zone of the low pressure elements is reduced in one half of the element and increased in the other half. It has been observed that increased axial spacing between the rotating and stationary blades of a stage reduces moisture erosion by causing break-up of the large moisture droplets streaming off the trailing edges of the stationary blades. Comparison of erosion depth on the three low TM pressure elements of a nuclear turbine has revealed a sizeable difference in the amount of erosion in one half of each of the double flow low pressure elements as compared to the other half of the double flow element.

Seals on stationary blades of more recent designs are usually limited to the straight through type as shown in FIG. 1, where all of the seals have the same diameter and the mating surface is cylindrical. The stationary blade seals are generally referred to by the numeral 20 and the rotating blade seals are referred by the numeral 22. For this application, the rotating blade seals 22 are also of the straight through type. In the case of the rotating blade seals 22 of FIG. 1, the number of seals could be increased to reduce leakage by reducing pitch between seals. However, this can increase the leakage because it reduces the dissipation of kinetic energy (called kinetic energy annihilation factor) leaving a seal, thereby increasing leakage. Moreover, the straight through seals do not dissipate all of the kinetic energy even at large pitches while stepped or staggered seals completely annihilate the kinetic energy. The magnitude of this parameter correlates with the ratio of seal clearance to seal pitch.

In the event of a seal rub, both straight through and staggered or stepped seals experience increases in the leakage area, thereby resulting in increased leakage. The clearance to pitch ratio increases, however, and so the seal leakage for straight through designs increases even more. The staggered seals create a convoluted path for the leakage by varying the diameter of the clearance space either by stepping the seal mating surface, as shown in FIGS. 2, 3 and 4, or by entered digiting seals alternately mounted on the rotating and stationary members, as shown in FIG. 5. In this instance, there is complete kinetic energy annihilation. Consequently, there is a lesser increase in leakage in staggered or stepped seals than on the straight through type. As a result, there is less performance degradation with time on units with stepped seals. In FIG. 2, the seal is known as a spring-loaded labyrinth seal, while FIGS. 3 and 4 represent radial seals for reaction blading of a large turbine. The seal shown in FIG. 5 is simply referred to as a double radial labyrinth seal FIG. 6 is an illustration of a more recent blade path with stepped or staggered seals 22 over the rotating blades and straight through seals 20 under the stationary blades. The stepped seals 22 on the lower sealing diameter of the rotating blades must be positioned far enough away from the step so that they do not contact it when the rotor moves to the right. This reduces the number of step seals that can be utilized on a given sealing surface length. In the design illustrated in FIG. 6, there are two straight through seals at each diameter or sealing land. This is to ensure that at least one seal is always effective at each land as the rotor moves back and forth axially.

A given number of step seals has less leakage than a larger number of straight through seals. However, because of this axial movement, the application of stepped seals and increasing the number of steps to reduce leakage is limited.

SUMMARY OF THE INVENTION

An object of the present invention is to provide an inner cylinder axial positioning system which is capable of increasing the number of seals and/or the number of different diameter lands without running the risk of machining off the seals when they contact the steps in the mating parts.

Another object of the present invention is to provide an inner cylinder axial positioning system which ensures that the stationary blades are located equidistantly from the mating rotating parts in both halves of a double flow turbine element.

These and other objects of the invention are met by providing a positioning system for a steam turbine element having a rotor with rotating blades, an inner cylinder with stationary blades, and an outer cylinder, the system including a plurality of moveable support members supporting the inner cylinder within the outer cylinder with the stationary blades and rotating blades at a predetermined axial position relative to each other, and means for driving the inner cylinder axially to compensate for axial movement of the rotor and thereby maintain the predetermined axial position of the rotating and stationary blades.

In another aspect of the present invention, a positioning method for a steam turbine element having a rotor with rotating blades, an inner cylinder with a stationary blades and an outer cylinder includes supporting the inner cylinder within the outer cylinder on a plurality of moveable support members, with the stationary blades and rotating blades at a predetermined axial position relative to each other, and driving the inner cylinder axially to compensate for axial movement of the rotor to thereby maintain the predetermined axial position of the rotating and stationary blades.

These and other features and advantages of the positioning system for a steam turbine element of the present invention will become more apparent with reference to the following detailed description and drawings.

BRIEF DESCRIPTION OF THE DRAWINGS

FIG. 8 is a schematic view of a positioning sensor positioned over a blade tip as used in the positioning system of FIG. 7A;

FIG. 9 is a schematic view illustrating a relationship between the electrical output of the position sensor as a function of the position of the blade tip relative to the position sensor;

DETAILED DESCRIPTION OF THE PREFERRED EMBODIMENTS

Figure 1:
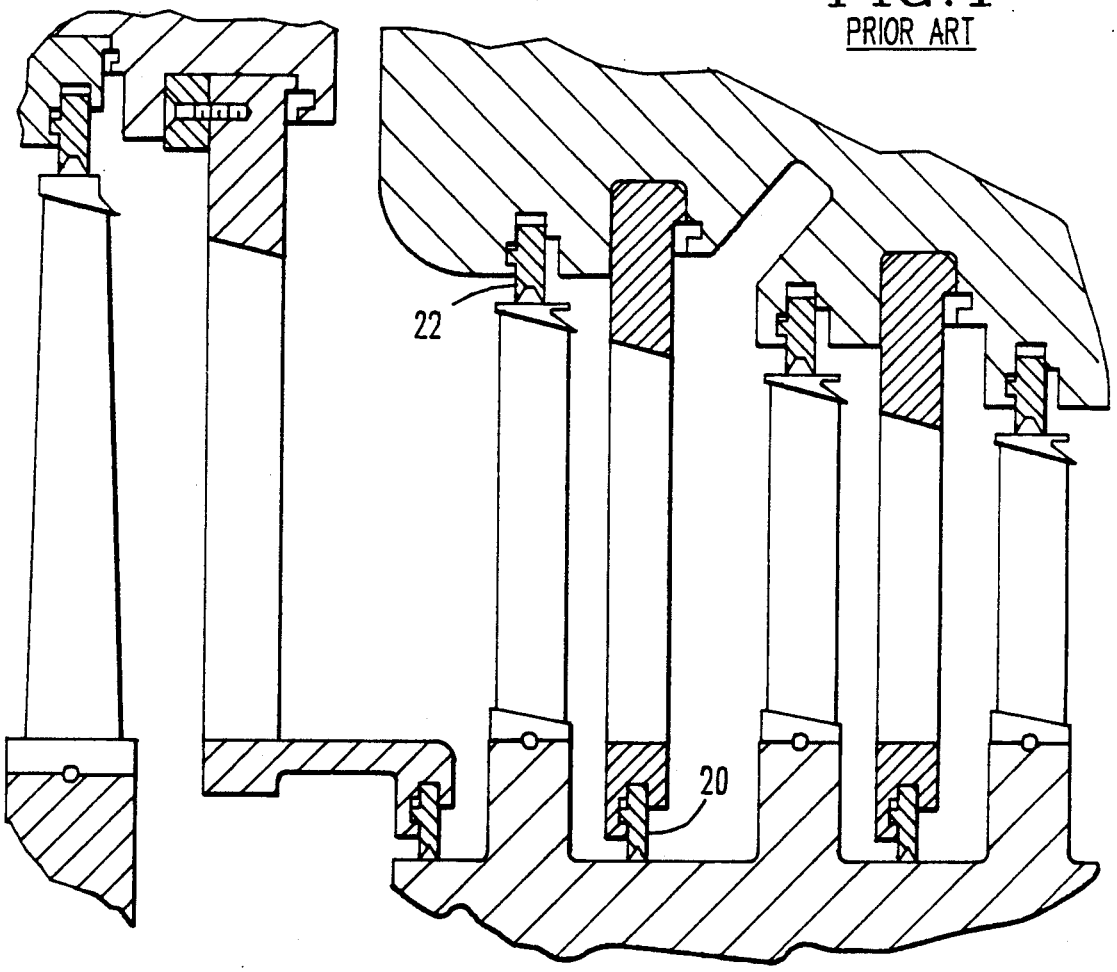
FIG. 1 PRIOR ART
FIG. 1 is a plan view of a portion of a steam turbine element of a steam turbine, showing a particular type of rotating and stationary blade seals.
Figure 2:
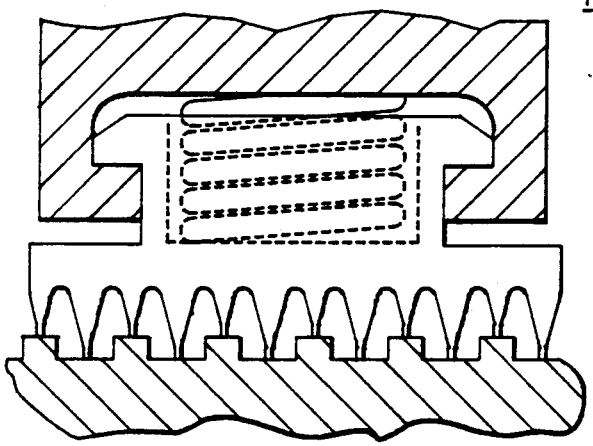
FIG. 2 PRIOR ART
FIGS. 2, 3 and 4 are plan views, partly in section, showing other types of known seals.
Figure 3:
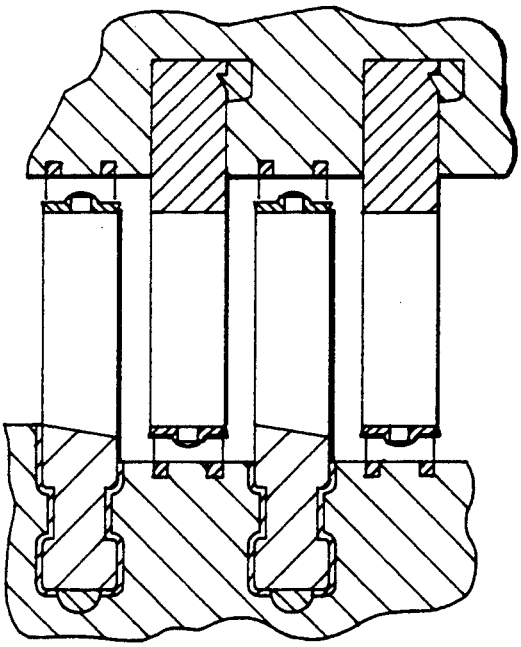
FIG. 3 PRIOR ART
Figure 4:
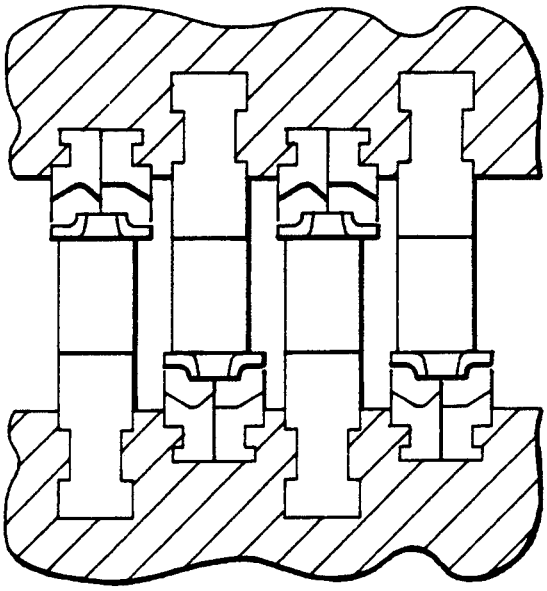
FIG. 4 PRIOR ART
Figure 5:
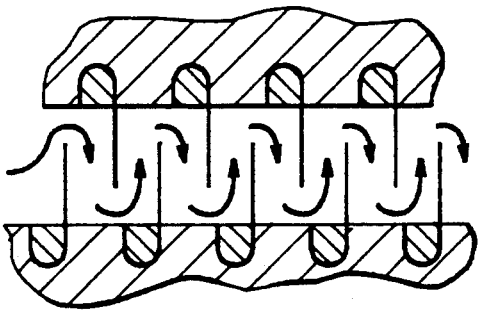
FIG. 5 PRIOR ART
FIG. 5 is a sectional view showing another type of known seal.

A steam turbine of a nuclear power generating facility includes low, intermediate, and high pressure elements. In the present invention, a low pressure element is generally referred to by the numeral 30 in FIG. 7A. The low pressure element 30 includes an outer cylinder 32 (only the lower half of which is illustrated) and an inner cylinder 34. The inner cylinder is made of two shell halves which are bolted together at opposite sides along a horizontal, longitudinally disposed flange. The outer cylinder is also provided in two halves, the upper half of which has been removed for the purpose of illustration.

A rotor 36 is journalled in the outer cylinder for rotation about the axial center line of the turbine and rotor. The rotor 36 carries rotating blades 38 in a plurality of rows, while the inner cylinder carries a plurality of stationary blades, also arranged in a plurality of rows. The rows of rotating and stationary blades alternate in a conventional manner.

Figure 7B:
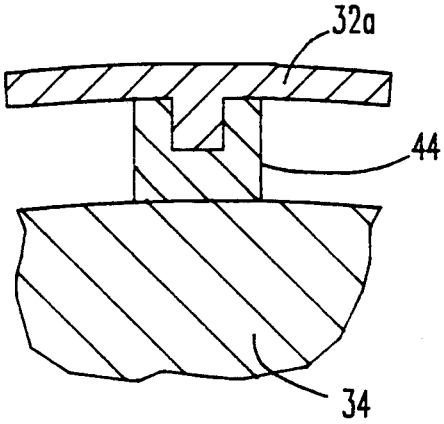
FIG. 7B is a detailed view of a locking key used to prevent lateral movement of the inner cylinder of the steam turbine element illustrated in FIG. 7A.

Other features of the turbine element are known, such as the low pressure steam inlet 40 and transverse alignment keys 42 and 44 which prevent the inner cylinder 34 from moving transversely when the upper shell half 32A of the outer cylinder is assembled (see FIG. 7B).

Four flex plates 46, 48, 50 and 52 provide moveable support means for supporting the inner cylinder 34 within the outer cylinder 32 with the stationary blades and the rotating blades of the inner cylinder and rotor, respectively, at a predetermined axial position relative to each other.

The stationary blades are located equidistant from the mating rotating parts in both halves of the turbine element 30, which is a double-flow type. The position is maintained by moving the inner cylinder axially and noting the position of specific rotating blades in each half of the double-flow element, relative to sensors on the inner cylinder or blade ring. When the sensor detect a shift in axial position, they send a signal to a hydraulic driving mechanism, which will be described in greater detail below.

Figure 7C:
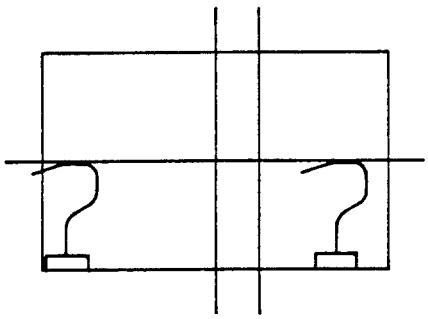
FIG. 7C is a schematic view showing flex plates used in the positioning system of FIG. 7A.
Figure 7A:
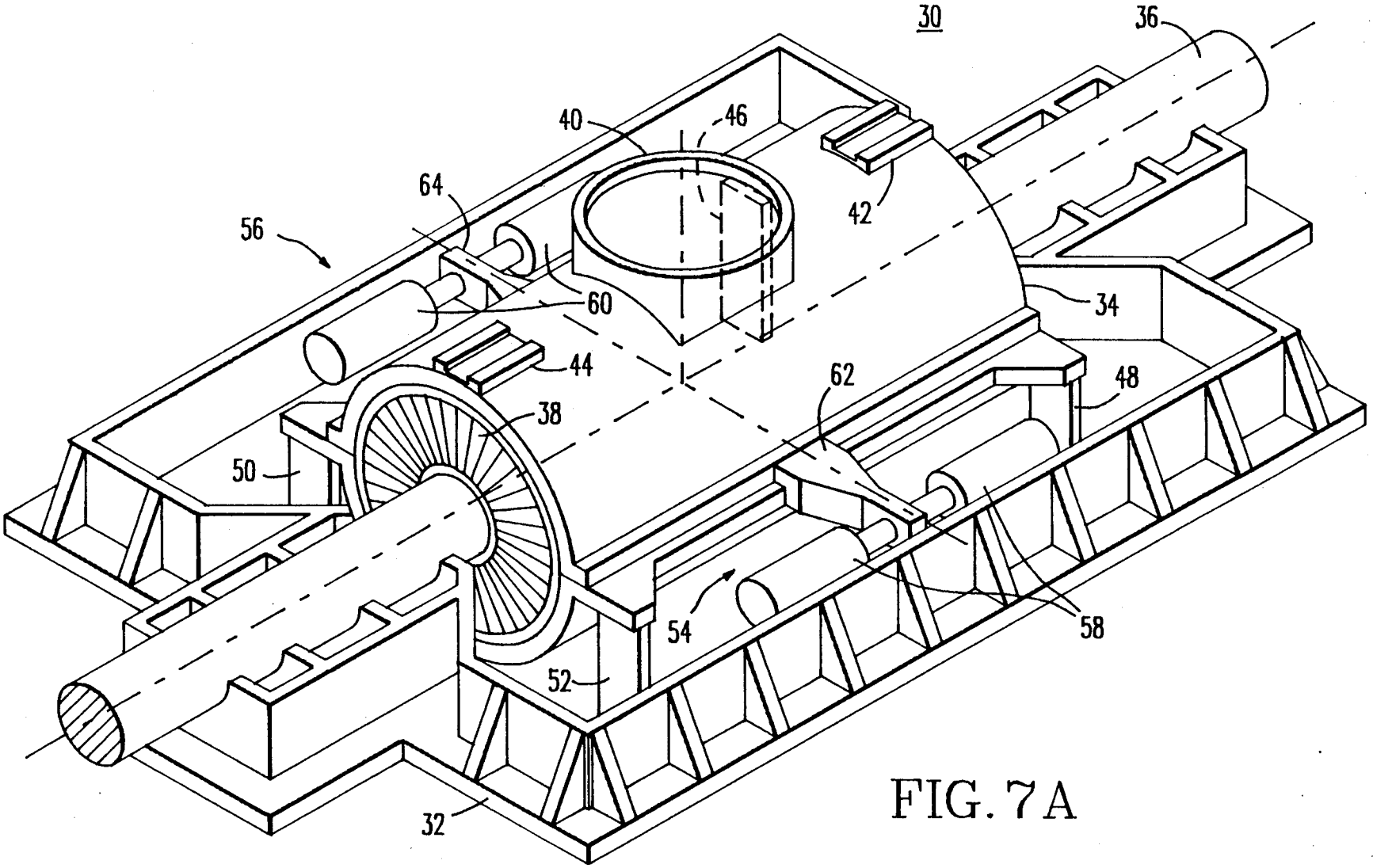
FIG. 7A is a perspective view of a steam turbine element employing a positioning system according to the present invention.

The inner cylinder 34 is mounted on the flex plates 46, 48, 50 and 52 which are equidistant axially from the steam inlet 40 and equidistant transversely from the rotational axis of the rotor. The transverse alignment keys 42 and 44 allow axial movement but restrict transverse or lateral movement, while allowing axial and transverse expansion of the inner cylinder. The inner cylinder's support from the outer cylinder may be any low friction device such as sliding plates, rollers, etc., but the flex plate supports are preferred. The major axis of each flex plate is in the transverse direction, while the minor axis is in the axial direction. The unbalanced force from a piston drive mechanism will deflect the flex plates axially allowing the inner cylinder 34 to move. If the flex plates are a couple of feet high, the elevation change of the inner shell, because of the axial deflection of the flex plates, would be minimal for an axial displacement of 0.75 inches, which would be a typical amount of displacement for the present invention. Although the flexing of the flex plate is not intended to cover a great distance, FIG. 7C illustrates flexing of the flex plates schematically to demonstrate the function of the flex plates.

Figure 6:
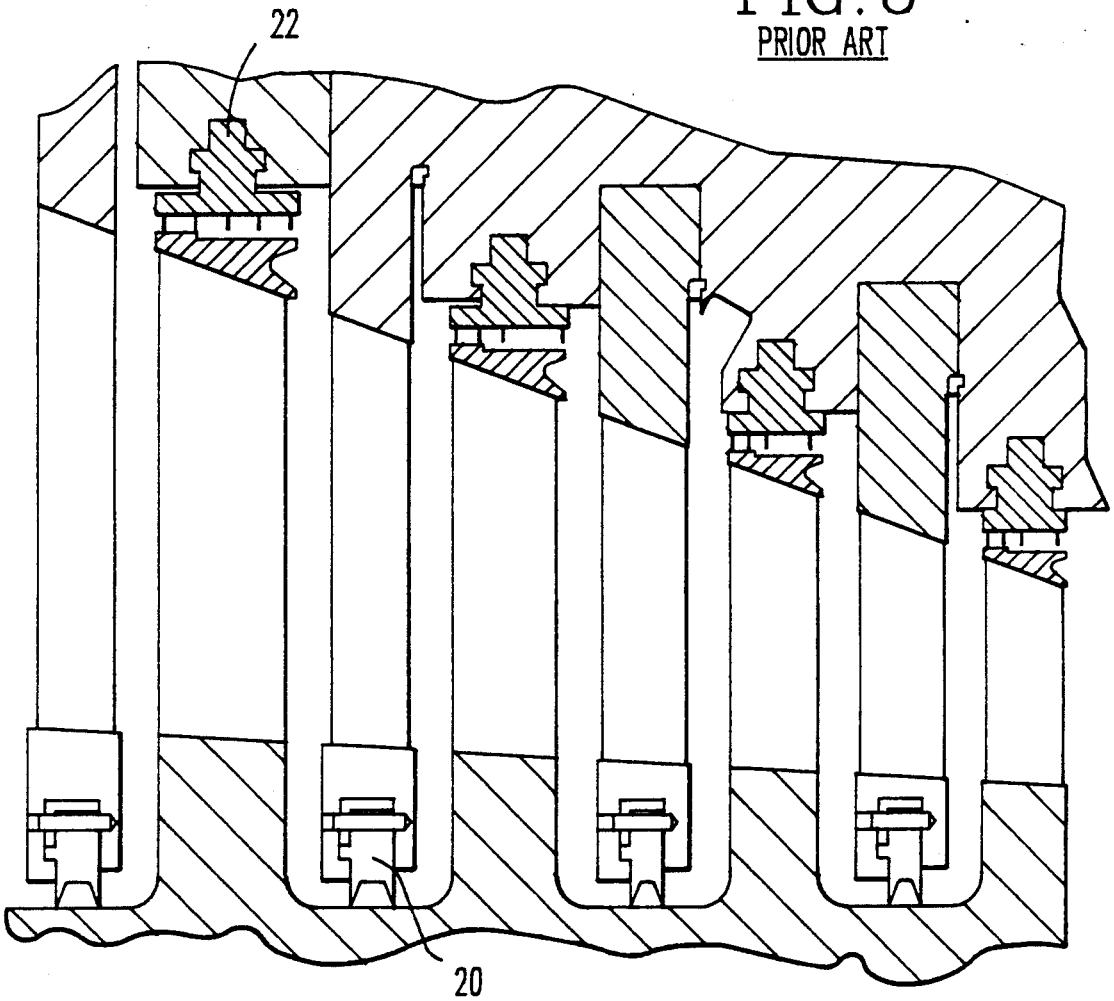
FIG. 6 PRIOR ART
FIG. 6 is a plan view of a portion of a steam turbine element of a steam turbine showing another type of known seal, with the blades labelled according to row number.

Because of the ability to position the inner cylinder 34 centrally with respect to the rotor, it is possible to use stepped seals under the stationary blades and to incorporate more steps and seals on the rotating blades. Because there is less relative movement, the space between rows 1R and 1C and rows 1R and 2C of FIG. 6 can be reduced allowing the blade designer to either reduce overall length or increase the area of the inlet zone ahead of row 1C or add an additional stage as needed, without compromising the inlet zone area.

In order to drive the inner cylinder 34 in either axial direction, a drive mechanism is provided on opposite sides of the rotor 36. Each drive mechanism includes a hydraulic motor 54 and 56, each of which may include a pair of hydraulic rams 58 and 60, respectively, which are used to drive a corresponding bracket 62 and 64 which are fixedly connected to the flange region of the inner cylinder 34 at opposite sides of the rotor 36 at approximately the transverse center line of the low pressure turbine element.

To effectively track the thermal movement of the rotor 36, the hydraulic piston or motor 58, 60 driving the inner cylinder 34 must be controlled by continuous feedback of the relative position of a point on the rotor and casing. The points of relative motion are preferably the trailing edge of the L-0 row blade tips and an adjacently positioned blade vibration sensor mounted in the inner cylinder. Referring to FIG. 8, the drawing illustrates the passage of a blade 66 under a position or vibration sensor 68. The sensor includes a casing 70, a magnet 72, and a coil 74. A gap 76 is formed between the end of the sensor 68 and the blade tip. The sensor 68 may be mounted in the inner cylinder by known techniques, and thus, further description is not warranted.

Figure 10A:
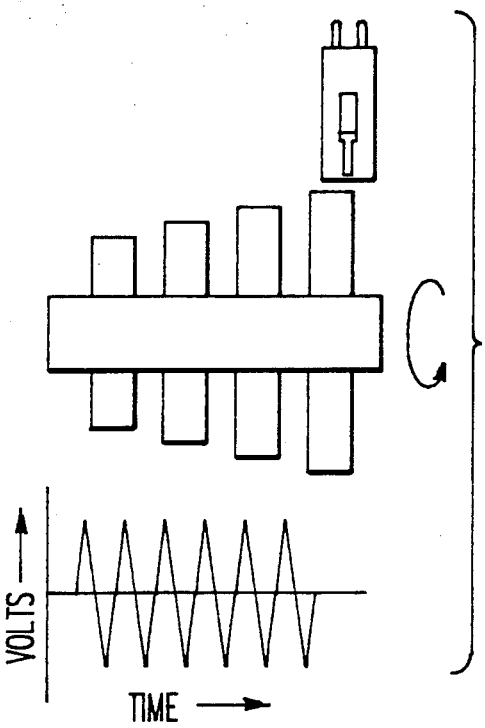
FIGS. 10A, 10B and 10C are schematic views showing the electrical output of the position sensor as a function of its proximity to a sensor pole of the position sensor.
Figure 10B:
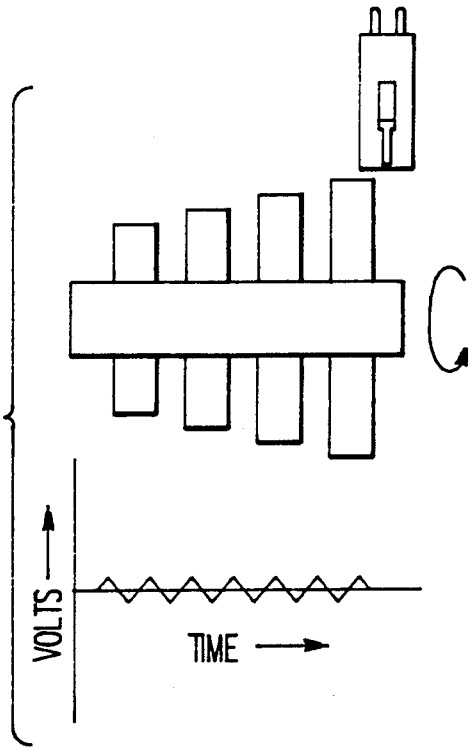
Figure 10C:
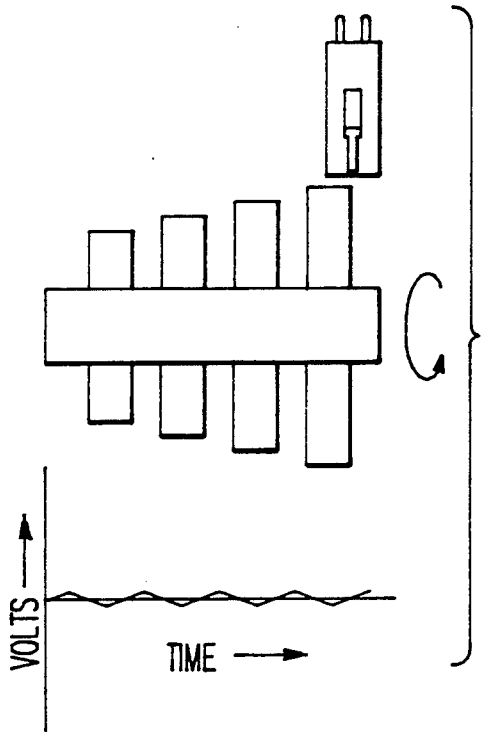
Figure 11:
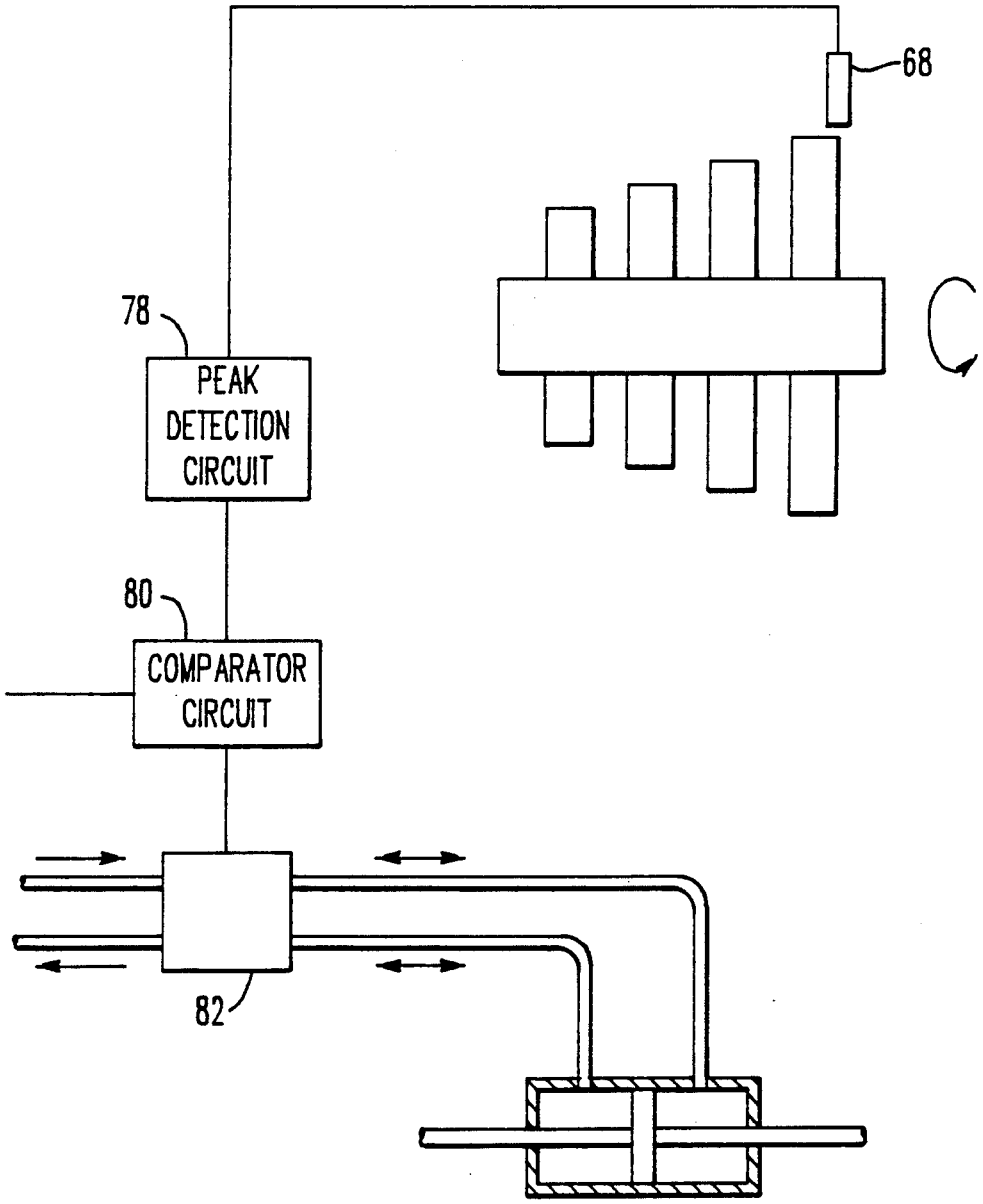
FIG. 11 is a schematic view of the positioning system including circuitry which facilitates adjustment of the inner cylinder based on hydraulic actuator feedback.

As the blade 66 passes under the sensor 68, an induced voltage is produced in response of the change in the magnetic reluctance. The reluctance is associated with the proximity of the blade tip during its passage under the small magnet pole of the magnet 72 (approximately 3.175 mm in diameter). A characteristic voltage signal, shown in FIG. 9, is produced in response to the rate of change of magnetic flux through the coil 74 within the sensor 68. The amplitude of the signal has a strong correlation to the proximity of the sensor to the blade tip. As the rotor moves axially with respect to the sensor, there comes a point where no part of the blade tip is under the sensor. At this point, the sensor signal starts to fall abruptly. The sensor signal amplitude typically drops an order of magnitude when the magnet pole within the sensor 68 is a fraction of an inch beyond the trailing edge of the L-0 row blade tips, as illustrated in FIGS. 10A-10C. The exact value of the signal drop depends on the nominal gap size between the sensor and the blade tips.

The magnitude of the blade vibration sensor signal within the small axial active region is an accurate measure of the rotor position within the inner cylinder 34. A d.c. signal proportional to peak blade vibration signal is produced by a circuit 78, which is referred to as the peak detection circuit. Thus, the AC signal produced by the sensor 68 is converted to a d.c. signal, which is designated V1. A comparator circuit 80 compares a reference voltage V2 to the position signal V1, and the result of that cmoparison produces a control signal which is delivered to a hydraulic actuator circuit 82 which controls an actuator valve of the hydraulic motor. If the d.c. signal exceeds the preset reference level, indicating a long rotor, the positive error signal causes the hydraulic drive actuator or motor circuit to displace the hydraulic piston and move the casing to the left until the error signal is reduced to zero. Likewise, if the d.c. signal falls below the preset level indicating a short rotor, the negative error causes the hydraulic drive or motor circuit to displace the hydraulic piston and move the inner cylinder 34 to the right until the error signal again returns to zero.

The temperature of the sensor will affect the sensor output signal to a small degree. This is related to the reduction of the permanent magnet strength the sensor and thermally induced changes in the sensor blade tip gap. The accuracy of the rotor position measurement may be further increased, therefore, by using a secondary reference sensor. Thus, a secondary sensor is placed slightly upstream and with equal gap to the primary sensor. In this position, it is unaffected by the motion of the rotor. The secondary sensor produces a reference signal that is used to scale the output of the primary sensor to compensate for changes in magnetic strength and gap. For example, if these result in a 2% drop in the secondary sensor, and adjacent primary sensor, a circuit causes the signal from the primary sensor to be scaled up by 2% before it is compared to the reference signal as described above. In this case, these effects on the primary signal are removed.

Numerous modifications and adaptions of the present invention will be apparent to those skilled in the art and thus, it is intended by the following claims to cover all such modifications and adaptions which fall within the true spirit and scope of the invention.

We claim:

1. A positioning system for a steam turbine element having a rotor supporting plural rows of rotating blades, an inner cylinder supporting plural rows of stationary blades in alternating relationship with the rows of rotating blades so that the inner cylinder has an axial length which encompasses the plural rows of rotating and stationary blades, and an outer cylinder, the system comprising:

a plurality of movable support members supporting the inner cylinder within the outer cylinder with the rows of stationary blades and rows of rotating blades at a predetermined axial position relative to each other; and means for driving the inner cylinder and thus the plural rows of stationary blades axially in a direction corresponding to a direction of axial movement of the rotor, thereby maintaining the predetermined axial position of the rows of rotating and rows of stationary blades.

2. A positioning system as recited in claim 1, further comprising sensor means disposed in the inner cylinder for detecting axial shifting of the rotor.

3. A positioning system as recited in claim 2, wherein the driving means is operative in response to the sensor means.

4. A positioning system as recited in claim 1, wherein the plurality of movable support members includes four flex plates equidistant axially from a steam inlet to the inner cylinder and equidistant transversely from a rotational axis of the rotor.

5. A positioning system as recited in claim 2, wherein the sensor means comprises at least four position sensors, with two sensors at each opposite axial end of the steam turbine element and at opposite sides of the inner cylinder.

6. A positioning system as recited in claim 1, wherein the driving means comprises first and second motors coupled to the inner cylinder at opposite sides thereof at about a transverse center line of the steam turbine element.

7. A positioning system as recited in claim 5, wherein the driving means comprises first and second motors coupled to the inner cylinder at opposite sides thereof at about a transverse center line of the steam turbine element wherein the two sensors on one side send control signals to the motor on the same side.

8. A positioning system as recited in claim 6, further comprising first and second brackets connected to the inner cylinder at opposite sides thereof, each being coupled to one of the first and second motors.

9. A positioning system according to claim 6, wherein each of the first and second motors is a hydraulic motor.

10. A positioning system according to claim 5, wherein two position sensors at one end are positioned adjacent tips of the rotating blades of an outermost row of blades, and aligned with a trailing edge of the rotating blades of the outermost row.

11. A positioning system as recited in claim 5, wherein each positioning sensor is a vibration sensor having an electrical output which varies as a function of blade tip proximity to the sensor, a peak voltage occurring when a trailing edge of a blade in the outer most row is directly aligned with a magnet pole of the vibration sensor.

12. A positioning system is recited in claim 11, further comprising a peak detection circuit receiving the electrical output of the vibration sensor and producing a d.c position signal, a comparator circuit for comparing the d.c. position signal to a stored reference signal, and a hydraulic actuator circuit for controlling an actuator valve of the driving means and thereby moving the inner cylinder, based on a difference between the reference signal and the d.c. position signal.

13. A method of positioning a rotor supporting plural rows of rotating blades relative to an inner cylinder supporting plural rows of stationary blades of a steam turbine element in alternating relationship with the rows of rotating blades so that the inner cylinder has an axial length which encompasses the plural rows of rotating and stationary blades, the method comprising:

supporting the cylinder within an outer cylinder with the plural rows of stationary blades and the plural rows of rotating blades at a predetermined axial position relative to each other; and driving the inner cylinder and thus the plural rows of stationary blades axially to compensate for axial movement of the rotor and thereby maintaining the predetermined axial position of the plural rows of rotating and plural rows of stationary blades.

14. A method as recited in claim 13, further comprising sensing the position of the rotating and stationary blades, and driving the inner cylinder in an axial direction based on the sensed position of the rotating and stationary blades.

15. A positioning system for a steam turbine element having a rotor with rotating blades, an inner cylinder with stationary blades, and an outer cylinder, the system comprising:

a plurality of movable support members supporting the inner cylinder within the outer cylinder with the stationary blades and rotating blades at a predetermined axial position relative to each other;

means for driving the inner cylinder axially to compensate for axial movement of the rotor and thereby maintaining the predetermined axial position of the rotating and stationary blades, wherein the plurality of movable support members includes four flex plates equidistant axially from a steam inlet to the inner cylinder and equidistant transversely from a rotational axis of the rotor, and sensor means disposed in the inner cylinder for detecting axial shifting of the rotor.

16. A positioning system as recited in claim 15, wherein the driving means is operative in response to the sensor means.

17. A positioning system as recited in claim 15, wherein the sensor means comprises at least four position sensors, with two sensors at each opposite axial end of the steam turbine element and at opposite sides of the inner cylinder.

18. A positioning system as recited in claim 15, wherein the driving means comprises first and second motors coupled to the inner cylinder at opposite sides thereof at about a transverse center line of the steam turbine element.

19. A positioning system as recited in claim 17, wherein the driving means comprises first and second motors coupled to the inner cylinder at opposite sides thereof at about a transverse center line of the steam turbine element wherein the two sensors on one side send control signals to the motor on the same side.

* * * * *